US006879307B1

(12) United States Patent
Stern

(10) Patent No.: US 6,879,307 B1
(45) Date of Patent: Apr. 12, 2005

(54) METHOD AND APPARATUS FOR REDUCING DRIVER COUNT AND POWER CONSUMPTION IN MICROMECHANICAL FLAT PANEL DISPLAYS

(76) Inventor: Ernest Stern, 31 Oxbow Rd., Concord, MA (US) 01742

( * ) Notice: Subject to any disclaimer, the term of this patent is extended or adjusted under 35 U.S.C. 154(b) by 518 days.

(21) Appl. No.: 10/150,817

(22) Filed: May 15, 2002

(51) Int. Cl.[7] ..... G09G 3/34
(52) U.S. Cl. ..... 345/84; 345/108; 345/211
(58) Field of Search ..... 345/84, 85, 211, 345/694, 695, 108, 212; 385/16, 18, 25, 26, 31, 37, 40–42, 48; 359/222–224; G02B 26/08; G09G 3/34, 3/02

(56) References Cited

U.S. PATENT DOCUMENTS 3,376,092 A * 4/1968 Kushner et al. ..... 359/222
3,871,747 A * 3/1975 Andrews ..... 385/147
4,087,810 A * 5/1978 Hung et al. ..... 345/206
4,113,360 A * 9/1978 Baur et al. ..... 345/84
4,234,361 A * 11/1980 Guckel et al. ..... 438/566
5,771,321 A * 6/1998 Stern ..... 385/31
5,808,594 A * 9/1998 Tsuboyama et al. ..... 345/89
6,452,583 B1 * 9/2002 Takeuchi et al. ..... 345/108

* cited by examiner

*Primary Examiner*—Alexander Eisen
(74) *Attorney, Agent, or Firm*—William G. Auton

(57) ABSTRACT

A micromechanical panel display driver is shown in which only one driver and control bus are needed for each color. Furthermore, the elements are made with uniform film thicknesses, thereby minimizing the number of steps needed to fabricate the display. Here 6 bits are provided with temporal and aperture weighting. The use of temporal weighting generally requires the activation of most pixels twice/frame, which consumes considerable power. It should also be possible to eliminate temporal weighting by redistributing the contact area into a larger number of aperture weights and by adding a row electrode. Here pixels are activated only in response to a charge in the image. This generally reduces the drive power, since many pixels in a typical image do not change from frame to frame.

3 Claims, 6 Drawing Sheets

METHOD AND APPARATUS FOR REDUCING DRIVER COUNT AND POWER CONSUMPTION IN MICROMECHANICAL FLAT PANEL DISPLAYS

STATEMENT OF GOVERNMENTAL INTEREST

The invention described herein may be manufactured and used by or for the Government for governmental purposes without the payment of any royalty thereon.

BACKGROUND OF THE INVENTION

The present invention relates generally to panel display systems and more specifically to an improvement in the invention of U.S. Pat. No. 5,771,321, issued Jun. 23, 1998 entitled "Micromechanical optical switch and flat panel display" by Stern, the disclosure of which is specifically incorporated herein by reference.

As mentioned in the above-cited patent, electronically controlled optical displays, and particularly flat panel optical displays, which generally are distinguished by their relative slimness and ability to produce a direct, as opposed to a projected, display image are of increasing technological importance for a wide range of applications. Flat panel optical displays that produce directly viewable video images such as text and graphics are, in theory, ideally suited as television monitors, computer monitors, and other such display screen scenarios. Yet the many flat panel optical display approaches heretofore proposed and investigated all exhibit serious disadvantages that have limited their practical applicability as a commercially viable flat panel display screen technology.

For example, the class of flat panel displays known as liquid crystal displays require complex manufacturing processes that currently produce relatively low yields, resulting in an overall size limitation for volume production. In operation, liquid crystal displays require considerable power to maintain a display backlight and these displays provide only a limited range of viewing angles. Electroluminescent display technology suffers from similar limitations, as well as a limited display color range and limited operational lifecycle.

Active-matrix display technology, which employs an active electronic device at each pixel location of a display, is likewise limited both by high power consumption, production yield constraints, and limited operational lifecycle. Color gas plasma display technology, like liquid crystal technology, requires a complex manufacturing process to produce an optical display; a gas plasma display relies on complicated packaging schemes for providing reliable containment of a noble gas, resulting in high manufacturing costs.

Various electromechanical display technologies have been proposed which generally rely on electronic control in conjunction with manipulation of mechanical elements in a display.

The Micromechanical Optical Switch and Flat Panel Display patent provides for the controlled release of light that is trapped inside a flat transparent plate by contacting the surface with micromechanical elements. The optical intensity and color of a pixel can be established by a combination of area and temporal weighting; area weighting is accomplished by using multiple elements within a pixel, whereby the element areas are varied in a binary progression in order to extract light from within the transparent plate in a binary fashion.

Problem: As many as 2000 pixels/row are needed in a HDTV display, and if we use 3 area weights/color and 3 colors/pixel then as many as 18,000 binary drivers are needed. In large displays the driver count can double in order to drive the display from both top and bottom. Even if the cost of a driver circuit is reduced to a few cents, the total cost of the drive circuits alone could exceed $1000/display, which could make the concept unattractive in commercial markets.

The task of improving micromechanical flat panel display systems is alleviated, to some extent, by the following U.S. Patents, the disclosures of which are incorporated herein by reference:

U.S. Pat. No. 3,238,396 issued to Nelson et al.
U.S. Pat. No. 3,871,747 issued to Andrews
U.S. Pat. No. 4,087,810 issued to Hung et al.
U.S. Pat. No. 4,113,360 issued to Baur et al.
U.S. Pat. No. 4,234,361 issued to Guckel et al.

As mentioned in Sterns' previous patent, typical mechanical display schemes have been limited by so many manufacturing complexities and/or operational constraints that they are as yet commercially impractical. Furthermore, the speed, resolution, and power consumption requirements of the latest optical display applications have heretofore been unachievable by conventional electromechanical display technologies. But electronic as well as electromechanical display technologies have all required design and performance trade-offs resulting in one or more suboptimal manufacturing or operational considerations.

SUMMARY OF THE INVENTION

The present invention is a system for reducing driver count in micromechanical displays. It is based on the principle that a single driver can be made to control several elements, provided the cost of drivers and elements remains approximately the same. We can accomplish this by varying both the response time of the elements and the time duration of the signals that control them using three elements.

DESCRIPTION OF THE PREFERRED EMBODIMENT

The present invention is a system for reducing the driver count in micromechanical panel displays, and is a direct improvement with application to U.S. Pat. No. 5,771,321 issued Jun. 23, 1998 entitled, "Micromechanical optical switch and flat panel display" invented by Stern. The prior Stern patent is discussed to show the applicability of this improvement as follows.

Figure 1:
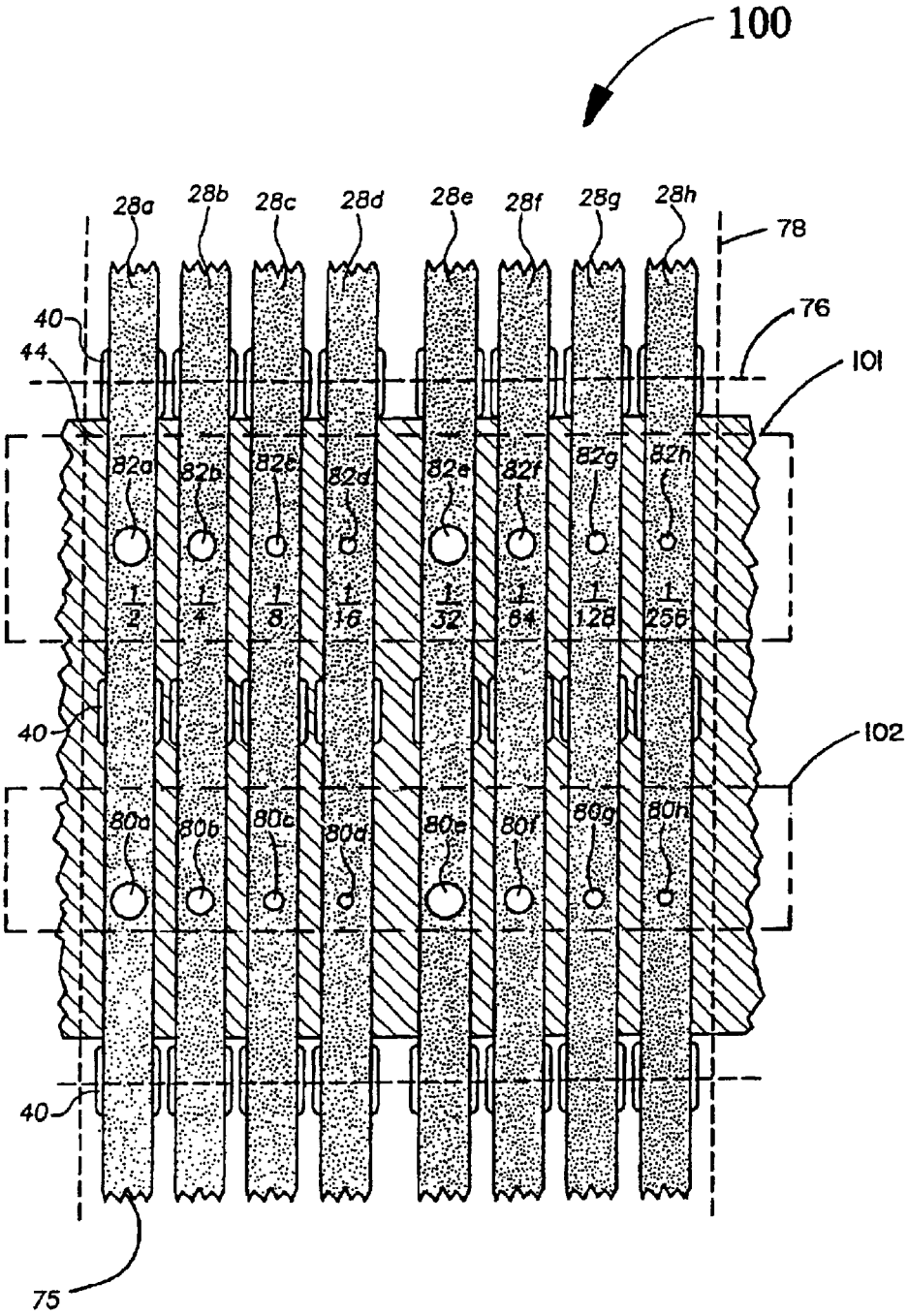
FIG. 1 is a schematic view of an example flat panel display pixel including eight optical mechanical switches in accordance with the invention in the Stern patent.

The system of the Stern patent is shown in FIG. 1. It provides an optical coupling switch and optical display employing an array of optical coupling switches that overcome limitations of past optical switches and displays to achieve superior display switch speed, display efficiency, compact geometry, and ease of manufacture. The optical coupling switch of the invention and the Stern patent, includes a light storage plate that is adapted to set up conditions for total internal reflection such that light injected into the plate is internally reflected. A light tap is disposed proximal to a coupling surface of a light storage plate for coupling internally reflected light out of the light storage plate and into the light tap when the light tap is brought into contact with the light storage plate coupling surface. The light tap is capable of movement in a direction perpendicular to the light storage plate in response to an applied electrostatic force. The optical coupling switch also includes a scattering mechanism, such as a scattering surface or scattering medium, for scattering light in the light tap. With this configuration, the optical coupling switch provides an uncomplicated geometry that accommodates a range of actuation schemes for efficiently producing high-speed optical switching.

As explained above, each micromechanical element in a flat panel display corresponds generally to the intersection of a column electrode and a line electrode, because an electrostatic force generated at such an intersection results in actuation of a mechanical tap beam to contact the light storage plate at the location of the intersection.

In one example, pixel geometry in accordance with the invention, as shown in FIG. 1, an area-weighting scheme is employed such that e.g. eight bits of viewing intensity are associated with a single pixel. Other pixel weighting schemes are equally applicable, as described below. The view in FIG. 1 is from the back of the display with the light storage plate removed such that the bottom surfaces of the mechanical tap beams are in view above the lower surface of the viewing substrate.

One factor providing digital weighting of the pixel bit intensities is the height of the stand-off's on the mechanical taps. Recall that the stand-offs are located on the lower surfaces of the mechanical tap beams in the areas where the beam contacts the light storage plate mesas. In FIG. 1, the stand-offs, if shown, would be located in the circular mesa contact areas 80*a*–801*h* and 82*a*–82*h*. The stand-offs are provided to suppress Van der Walls attractive forces that could develop when an extended area of the tap beam makes mechanical contact with a light storage plate mesa, as discussed above. The four leftmost tap beams each include stand offs having a height of, e.g. about 200 Å, while the rightmost tap beams each include stand-offs having a much taller height, e.g. of about 1500 Å.

Considering again the pixel bit weighting scheme provided by the Stern invention, other weighting schemes, e.g. temporal, or a combination of temporal and area weighting schemes, can also be employed. Such a combination scheme may in some cases be preferable because an all-area weighting scheme requires a dedicated electronic driver for each of the mechanical tap beams in the pixel. In one example, a combination temporal/area weighting scheme that provides eight-bit weighting, a sequence of only four different tap beams and four corresponding mesa contact areas is required, e.g. of relative sizes 1, ¼, 1/16, and 1/64. The switching speed for setting pixel line electrode voltages is then doubled to support two temporal settings for each color time slot, namely a short-duration coupling and a long-duration coupling having a coupling time twice that of the short-duration setting; this results in a temporal weighting of either 1 or ½ for each mechanical tap beam addressed.

Figure 2:
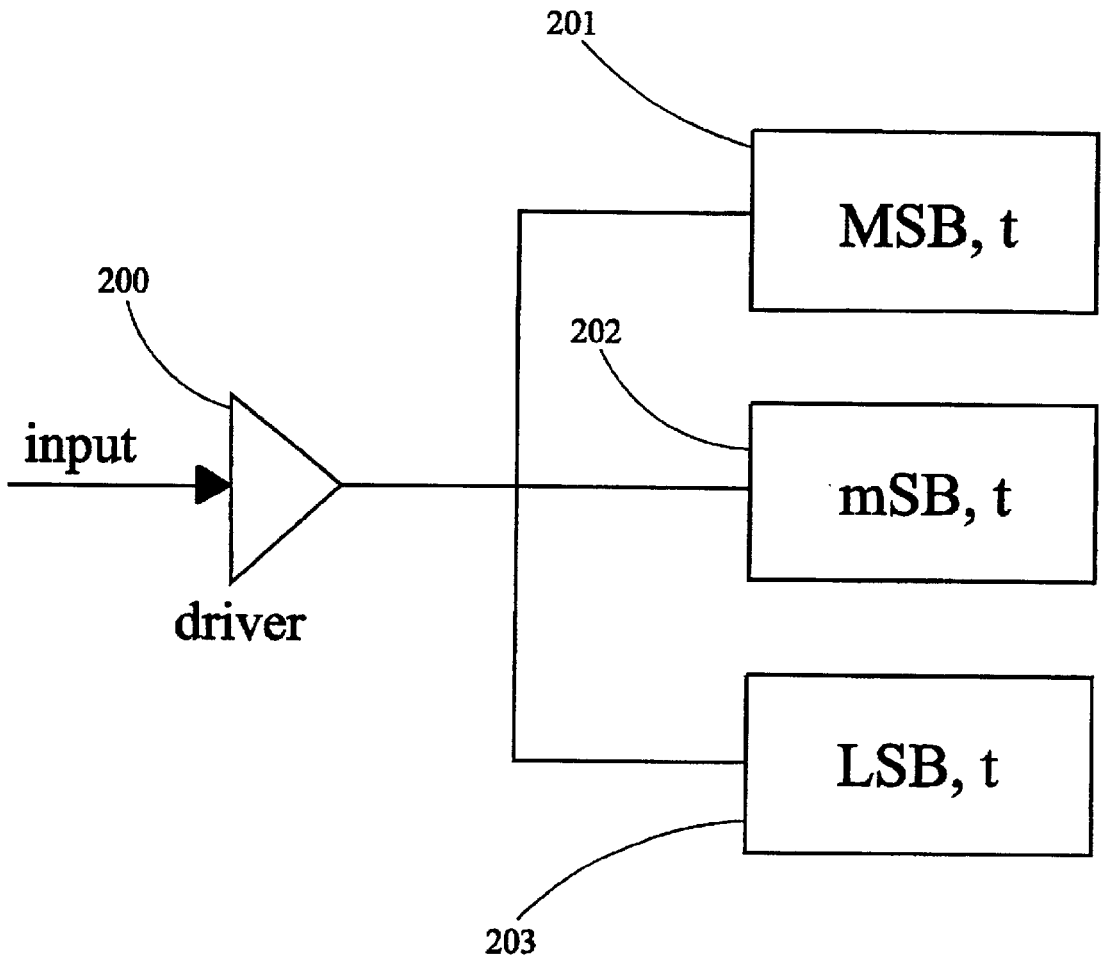
FIG. 2 is a schematic diagram of 3 aperture bits, each with a characteristic switching time, driven in parallel.
Figure 3:
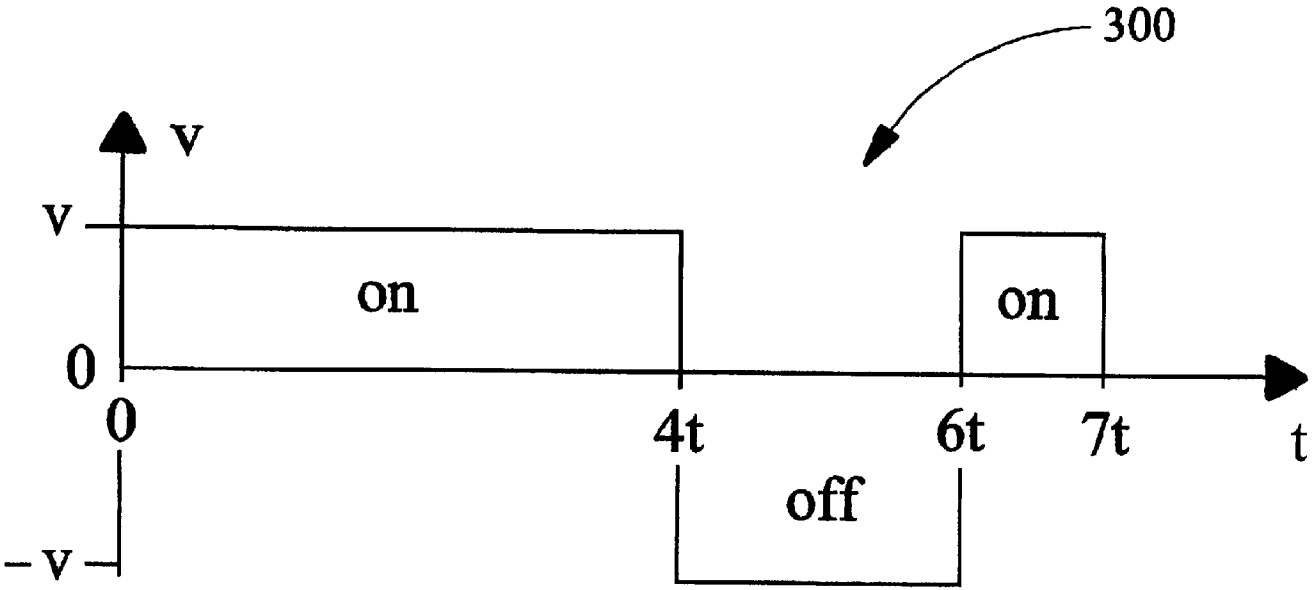
FIG. 3 is a chart of the input control signal for ideal elements of FIG. 2.

In the present invention, the physical parameters and voltages are chosen so that each element responds to a control signal with a duration equal to its switching time, but stays substantially in its preset position if the control signal duration is less than the switching, time (about half). Suppose the switching time of the least significant bit, (LSB)=$\tau$, the middle significant bit, (mSB)=$2\tau$, and the MSB=$4\tau$ (as in FIG. 2), then the control signal example in FIG. 3 would turn on all elements in response to the first pulse. The second pulse would cause an ideal MSB to stay in its preset position, but the mSB and LSB would respond (turned off). Similarly, only the LSB responds to the third pulse (turned on). The elements are set within the time available for an active line, and then stay at this setting until the next frame. During the active period the less significant bits are temporarily driven to the wrong position. This produces a negligible error in the weight setting of the pixel that is less than 1/n, where n=number of lines in the display. For example, if n=1200, and there are 30 interlaced frames/s, and there are two temporal and 3 aperture bits, then the time available to set each line=$(60\times600\times3)^{-1}$=9.26 $\mu$s. The switching time available for the ideal LSB is 1.32$\mu$. However, real elements will move about ¼ of the gap by a control signal with a duration of half the element switching time, and it may therefore be necessary to insert a short pulse with a duration of $\tau$ at $6\tau$ to reset the MSB and at $7\tau$ with a duration of $\tau/2$ to reset the mSB. This measure would require a minimum switching time of 1 $\mu$s for the LSB, which is readily achievable with micromechanical elements.

The time $\Delta t$ required to move an element an increment of $\Delta x$ is proportional to the square root of the acceleration $^{-1}$, or $$\Delta t_i=[2\Delta x/a_i+(v_{i-1}/a_i)^2]^{1/2}-v_{i-1}/a_i,$$

$$a_i=(F_e-F_m)/\rho wLd,$$

$$v_i=v_{i-1}+a_i\Delta t_i;\ \text{where } v_{i-1}=\text{initial velocity, } i=0, 1, 2, 3, 4, 5 \ldots$$

The instantaneous gap between element and substrate $x_i=x_{i-1}+\Delta x$, $\rho$=density, w=width, d=thickness, L=length of the flexible transparent element.

The mechanical force $(F_m)_i=4T\ wd(g-x_i)/L$; where T=tensile stress, g=maximum gap.

The electrostatic force $(F_c)_i=(\epsilon_o/2)w_mL(V/(x_i+d/\epsilon_r))2$; where $w_m$=width of electrode, V=voltage across electrodes, $\epsilon_r$=relative dielectric constant of flexible element.

If the initial velocity of an element=0, then the time needed to switch the element is proportional to $[F_c-F_m/\rho wLd]^{-1/2}$, and the switching time is doubled if both $F_c/\rho wLd$ and $F_m/\rho wLd$ are reduced by a factor of 4.

Figure 4:
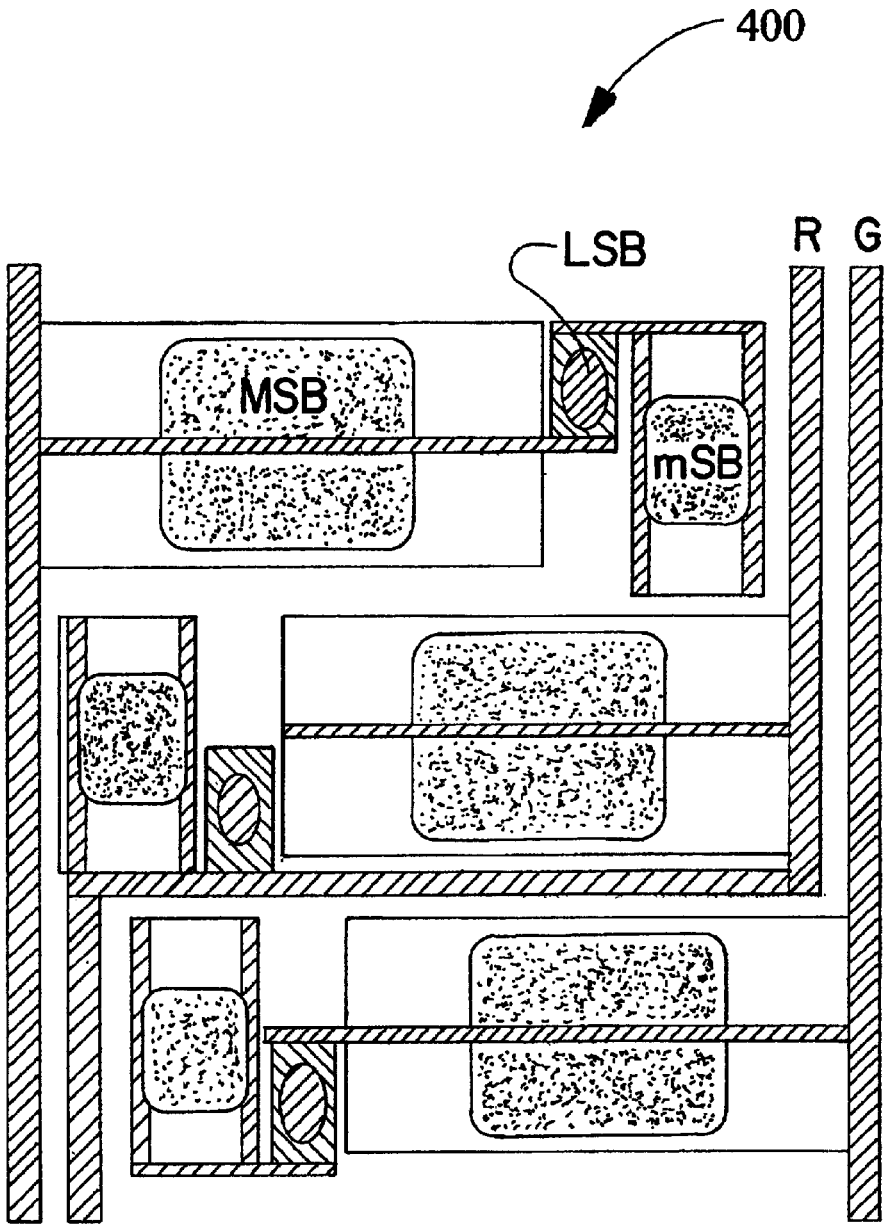
FIG. 4 shows a three-color layout for a square pixel with a filling factor of 7%. Aperture weights are in a 1, 4, 16 ratio and switching times are in a 1, 2, 4 ratio.

One obvious way to vary the switching time is to add different values of passive mass to the three aperture weights, but this approach increases the number of fabrication steps. A more desirable approach avoiding additional fabrication steps is achieved by setting the ratios $(W_{m1}/w_1)/(w_{m2}/w_2)=4$ and $L_2/L_1=2$ in order to double the switching time. A 6-bit gray scale can be achieved with two temporal weights of 1, 2 and three area weights of 1, 4, 16 having switching times of $\tau$, $2\tau$, 4 $\tau$. A layout of a typical pixel which incorporates these principles is depicted in FIG. 4 where individual elements are scaled to provide both the aperture weights of 1, 4, 16 for each color and switching time is doubled from LSB to mSB and again from mSB to MSB. Here the minimum dimensions would be 10 $\mu$m for 500×500 $\mu m^2$ pixels.

Figure 5:
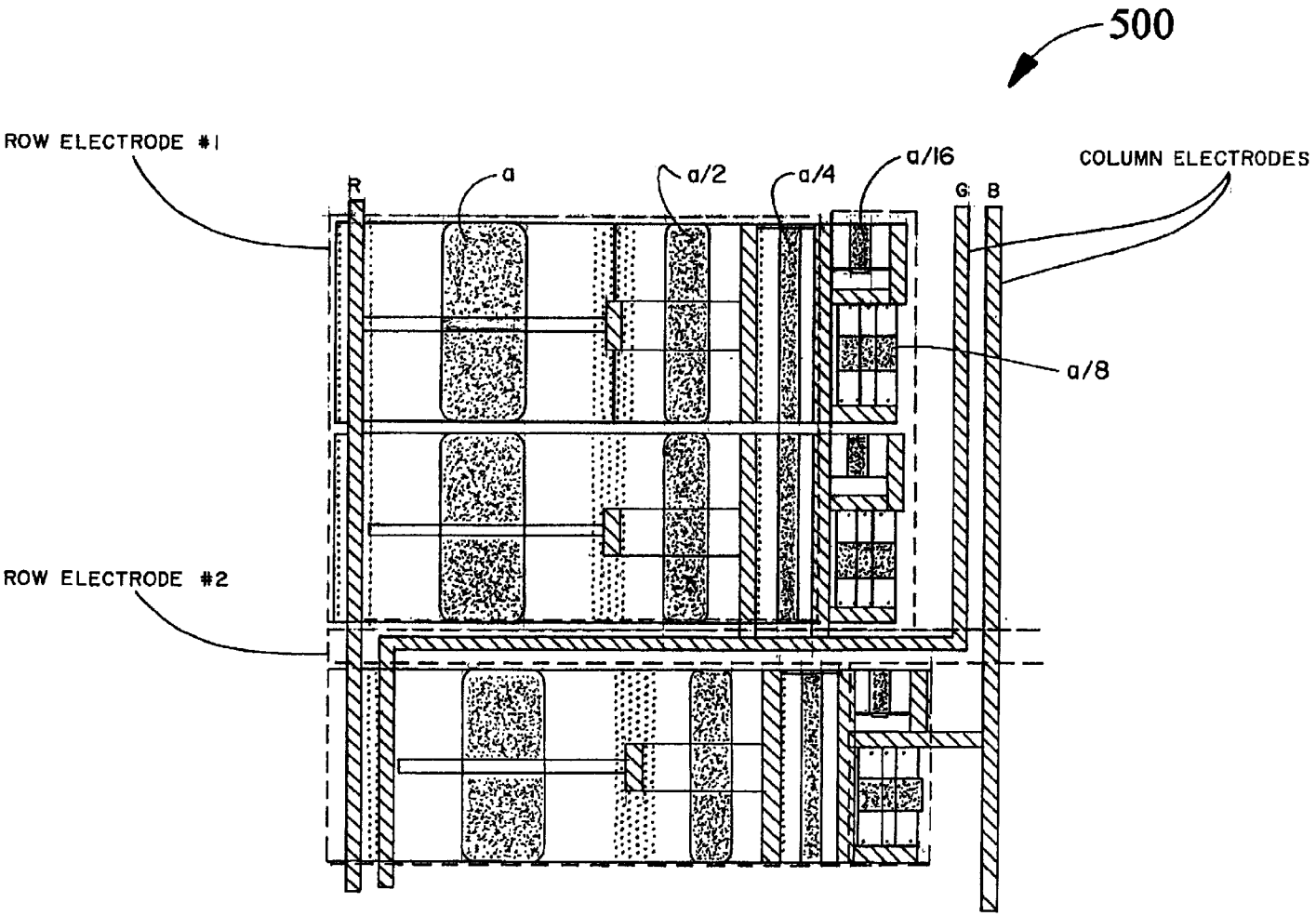
FIG. 5 is a three-color layout for a square pixel with a filling factor of 7%. Aperture weights are in a 1, 2, 4, 8, 16 ratio. The two least significant bits are activated with row electrode #2 and the remainder by row electrode #1. The timing sequence for controlling the five bits is depicted in FIG. 6.
Figure 6:
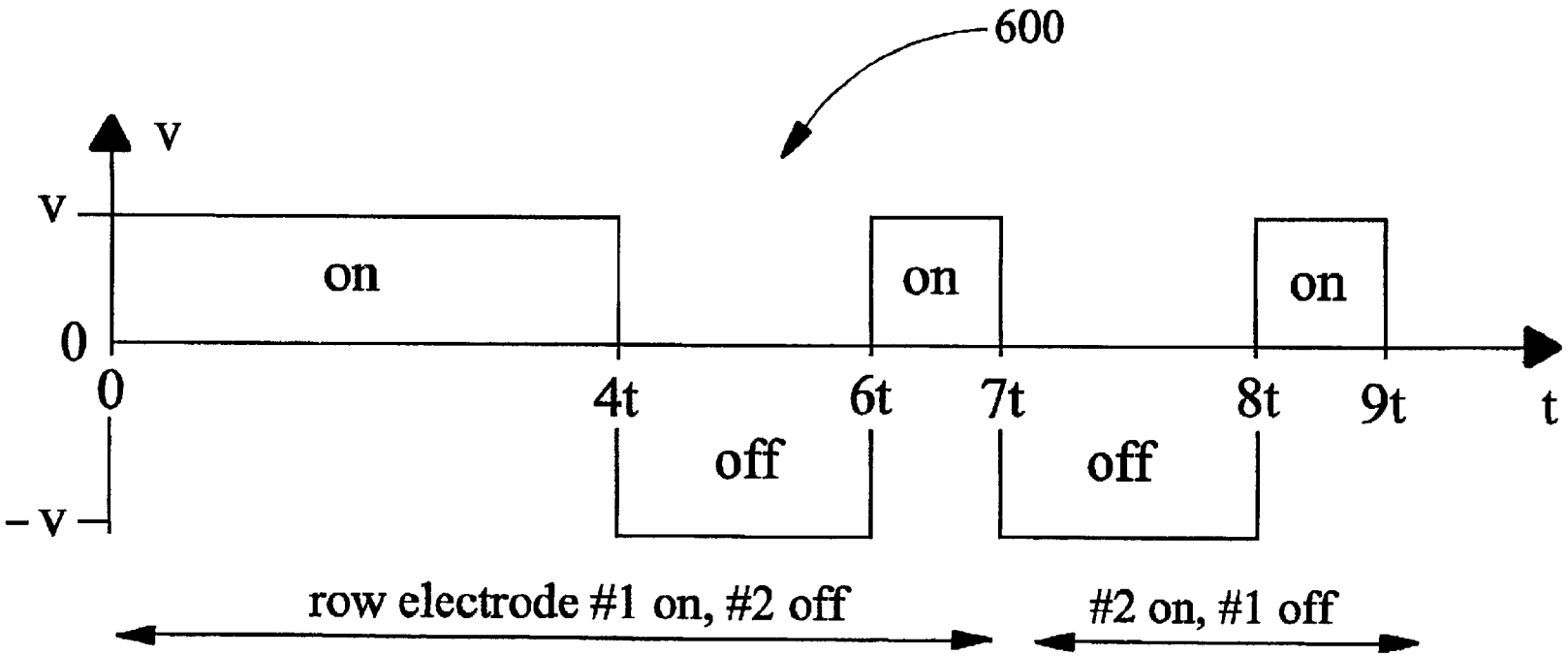

The advantages of this technique are that only one driver and control bus are needed for each color. Furthermore, the elements are made with uniform film thicknesses, thereby minimizing the number of steps needed to fabricate the display. Here 6 bits are provided with both temporal and aperture weighting. The use of temporal weighting generally requires the activation of most pixels twice/frame, which consumes considerable power. It should also be possible to eliminate temporal weighting by redistributing the contact area into a larger number of aperture weights and by adding a row electrode, as in FIG. 5 and FIG. 6. Here pixels are activated only in response to a chance in the image. This generally reduces the drive power, since many pixels in a typical image do not change from frame to frame.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A micromechanical panel display driver comprising: a plurality of aperture bit elements that each can be triggered to output micromechanical panel display illumination signal and which are each driven in parallel by having separate aperture weights and separate switching times, which allows a single driver signal to trigger them with a driver signal; and a single driver amplifier, which emits said driver signal which has an adjustable time duration that allows selectable aperture bit elements to be driven with one signal.

2. A micromechanical panel display driver, as defined in claim 1, wherein said plurality of aperture bit elements comprise a set of three aperture bit elements, which are driven in parallel and which each illuminates a distinct and separate color on a micromechanical panel display.

3. A micromechanical panel display driver, as defined in claim 2, wherein three aperture bit elements comprise a first, second and third aperture bit elements with respective aperture weights of 1, 4 and 16 and switching times of a 1, 2 and 4 ratio with respect to each other.

* * * * *